United States Patent [19]

Ewert et al.

[11] Patent Number: 4,989,439

[45] Date of Patent: Feb. 5, 1991

[54] SPRINGBACK STRETCH PRESS

[75] Inventors: Lee R. Ewert, Garden Grove; Sumner B. Sargent, Bell; Walter Leodolter, Rancho Palos Verdes, all of Calif.

[73] Assignee: McDonnell Douglas Corporation, Long Beach, Calif.

[21] Appl. No.: 272,403

[22] Filed: Nov. 17, 1988

[51] Int. Cl.[5] ..... B21D 37/02

[52] U.S. Cl. ..... 72/372; 72/296; 72/702; 76/107.1

[58] Field of Search ..... 72/296, 297, 702, 372; 76/107.1

[56] References Cited

U.S. PATENT DOCUMENTS 4,704,886 11/1987 Evert et al. ..... 72/296
4,802,357 2/1989 Jones ..... 72/389

FOREIGN PATENT DOCUMENTS 0659238 4/1979 U.S.S.R. ..... 72/296

*Primary Examiner*—David Jones
*Attorney, Agent, or Firm*—Curt L. Harrington; Gregory A. Cone; John P. Scholl

[57] ABSTRACT

A device and method for taking to account the elasticity of materials during bending operations to cause the proper amount of overbending such that after springback and while at rest, the material assumes its intended shape.

20 Claims, 3 Drawing Sheets

SPRINGBACK STRETCH PRESS

BACKGROUND

In some manufacturing operations, usually in the final stages of production, bending operations are performed upon metallic or plastic structural members. The bending process is a complex process which seeks to avoid stress concentration of the points of bending. This is usually accomplished through a combination of stretching and bending across a preformed die.

The way that the workpiece is bent and stretched depends upon the shape of the workpiece and the sequence of bends to which it is subjected. Some of the modern workpiece stretching presses are computer controlled in order to give repeatable results in the bending process.

However, even these machines must be set up on a trial and error basis, and several workpieces must be destructively experimented upon in order to get first approximations of the ideal bending sequence.

Furthermore, even before this trial and error approach can be carried out, the bending die over which the workpiece is stretched must be present. The design of the bending die very nearly approximates the void which is surrounded by the finally shaped workpiece. Since the workpieces normally have a moment of elasticity, they tend to try to assume a shape having a radius of bend of lesser extent than was desired. This condition is known as springback and is defined as the elastic recovery of metal after a stress has been applied. The shape that the workpiece springs back to is almost never the shape optimally desired, nor the shape which conforms to the bending die. Reworking the workpiece to mitigate the effects of springback have been known to increase the unit cost of production by 50%.

Given the above limitations, one method has been to cause the workpiece to become excessively bent in the bending direction, such that upon springback the workpiece will assume the proper shape. This method invites the die designer to guess what the shape of the bending die should be. Even if a bending die designer were fortunate enough to guess the proper shape of the bending die for one particular type of workpiece, a slight change in workpiece construction can cause an improper springback. Such a change in workpiece might result from a change in suppliers.

In addition, all previous efforts at attempting to solve the springback problem was directed toward circumferential part configurations. This was due to the mathematical complexity of the problem. Although 70% to 80% of the frames formed are circumferential, significant utility advances in the ability to handle more complex shapes would be a most welcome addition to the part forming art.

SUMMARY OF THE INVENTION

The present invention solves the springback problem by allowing interactive computer design of the bending die as well as the bending procedure. The inputs to the computations come from the characteristics of the workpieces. Precise elongation control of the workpiece while bending is necessary to produce accurate and repeatable contours.

The die shape, relative location on the stretch press and machine geometry are completely integrated. The calculations performed will determine the coordinated motion of the bending press to precisely control the elongation of the workpiece during forming.

First, a mathematical model of the stretch wrap forming process is formed. The die designed from the mathematical model is fitted to the stretch press. A digitizing device is used to record the exact position and shape of the die in computer memory. The computer then calculates the hydraulic pressure range in which the stretching and bending process will be operating within.

In addition, the inventive methods disclosed herein for correcting the radial sections of workpieces for springback, there is a method for springback correcting dies with compound contours. This new compound contour method is software implementable and was developed utilizing the basic equations from the more simple radial cases. Two additional sets of equations divide a complex shape into any number of discrete sections and redefine that shape in terms of tangential arc segments. This eliminates the need to develop a special case equation for each shape. The actual springback calculation is performed separately and sequentially on each arc segment.

A metallurgical stress/strain curve is built into the software to compensate for the nonlinearity involved in work hardening the material. Next, the amount of elongation is supplied to the computer which can come from the first step in which the die was designed, or if the die already exists, from the size of the die and workpiece. In the event fine tuning is needed, the operator can change the strain variables. The invention facilitates this control by eliminating pressure as an adjustment.

BRIEF DESCRIPTION OF THE DRAWINGS

The structure and method of operation of the invention, together with additional advantages thereof, will be best understood from the following description of specific embodiments when read in connection with the accompanying drawings, in which:

FIG. 1, including

DETAILED DESCRIPTION OF THE PREFERRED EMBODIMENTS

Figure 1A:
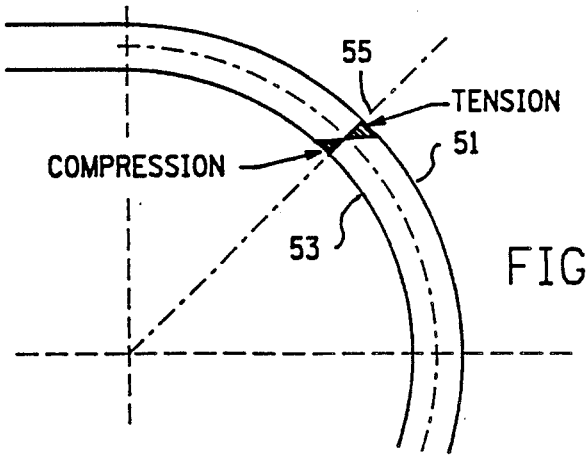
FIGS. 1*a*, 1*b* and 1*c*, illustrates a workpiece formable by the device and method of the present invention.
Figure 1B:
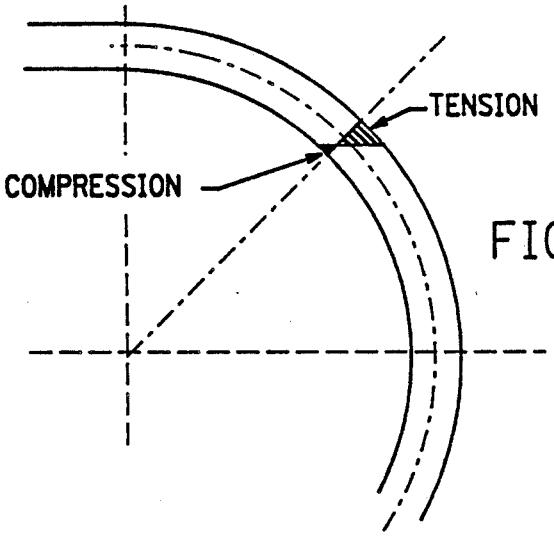
Figure 1C:
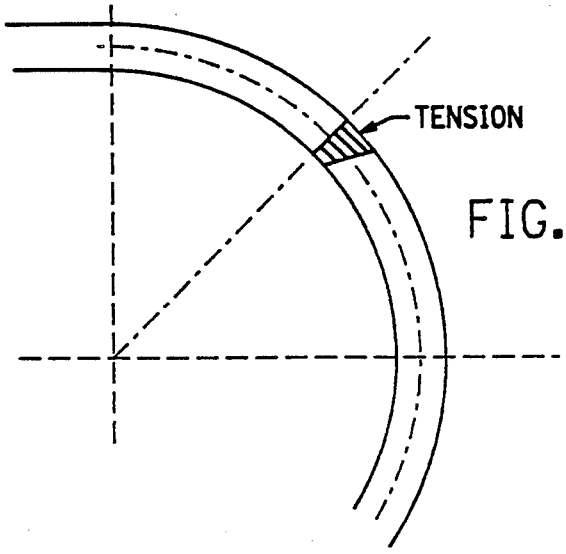

Referring to FIGS. 1*a*, 1*b* and 1*c*, a sample workpiece is shown in various stages of bending. FIG. 1*a* illustrates a workpiece 51 bending against a die 53 without stretching. Note that along a line 55 normal to the bending area, both tension and compression are produced. FIG. 1*b* illustrates workpiece 51 bending with some stretching. The breakeven point between tension and compression moves radially inward as the tension increases and the stretching increases. Any time the breakeven point is left within the axis of workpiece 51, an extreme springback occurs. FIG. 1c illustrates workpiece 51 with enough stretching during the bending operation that no compression is formed.

Figure 2:
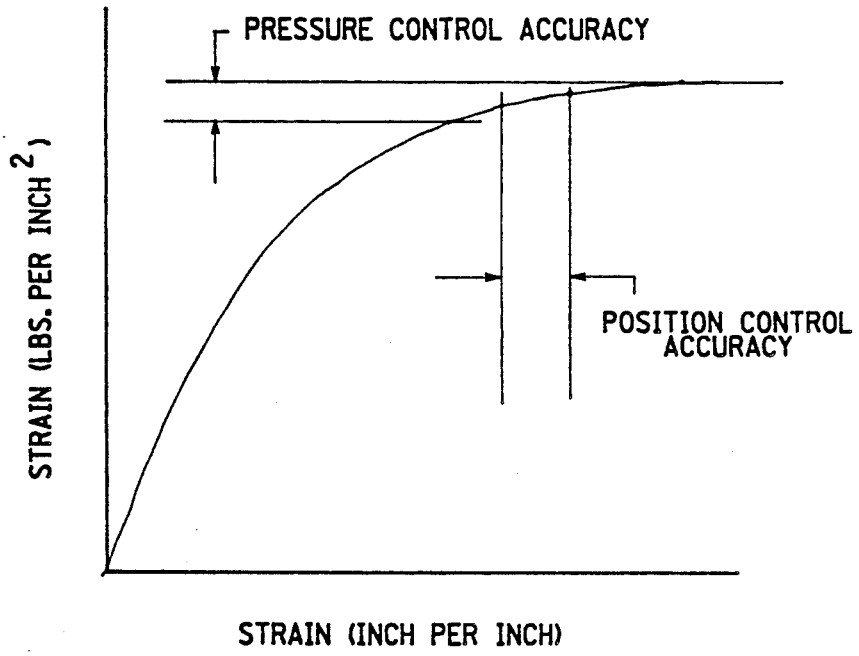
FIG. 2 is a stress/strain curve illustrating the theory of the present invention relating to the workpiece of FIG. 1.

The present system relies upon the maintenance of constant hydraulic pressure to cause stretching during the bending cycle. Referring to FIG. 2, a stress strain curve is illustrated. In a typical stress strain curve, the stress ordinate is measured in thousands of pounds force per square inch, and the strain abscissa is measured in inches of stretch per inch of starting material.

The curve of FIG. 2 rises sharply, indicating that as a function of stretch, the strain increases rapidly at first. The curve asymptotically approaches a constant stress for continuing amounts of strain. Because of the leveling off effect, any two points on the curve will have a shallow rise corresponding to a long run in the leveled off area. Since it is desirable to control the condition of workpiece 51 of FIG. 1 as it relates to the stress strain curve of FIG. 2, two control parameters are possible. The location on the curve of FIG. 2 may be controlled by controlling the stress or the strain. If the stress is controlled, a very narrow bandwidth is available as is shown by the narrowly separated horizontal lines. If strain is controlled, a much wider band of control is available.

Springback, expressed as the ratio of tool radius to part radius, is related to material properties according to the following equation (1):

$$\frac{R}{R'} = \left(1 - \frac{E_T}{E}\right) \tag{1}$$

R is the radius of the bending die 53, R' is the radius of the part after springback, E is the Young's modulus equal to $1.0\times10^7$ lb/in$^2$, and $E_T$ is the tangent modulus do /d at the forming strain. $E_T$ in equation (1) is the effective modulus of the entire section accounting for strain hardening effects due to different strains and strain rates. Since it is difficult and unpractical to develop stress strain curves for specific geometry conditions, it is better to use data derived from tensile specimen tests of workpiece 51 which have been strained at a given strain rate. The appropriate corrections can then be incorporated.

The part of the stress strain curve of FIG. 2 near the leveling off section is referred to as being beyond yield. This portion of the curve can be represented by the following mathematical relationship, equation (2):

$$\sigma = C\epsilon^n. \tag{2}$$

$\sigma$ is the stress, $\epsilon$ is the strain, C is a material constant of 128.34853 KSI, or thousands of pounds per square inch, and n is the strain hardening coefficient of 0.36974. The specific values given in this example are specific to an alloy known as 7075 Aluminum. The tangent modulus $E_t$ is defined as the slope of the stress strain curve and is given in equation (3) as:

$$E_T = nC\epsilon^{(n-1)} \tag{3}$$

$E_T$ in equation (3) does not take strain hardening into account. It is assumed that the strain rate characterizing the behavior shown in FIG. 1 represents the strain rate of the innermost length of the workpiece 51. The necessary corrections for the faster strain rates at the outer peripherae of the bend are incorporated into the values for the geometry correction K of the workpieces 51.

The derivation of K begins with equation (4) for the strain difference between the outer fiber strain $\epsilon_o$ and the inner fiber strain $\epsilon_i$, as follows:

$$\Delta\epsilon = \epsilon_0 - \epsilon_1 = \left(\frac{h/2}{R' + h/2}\right) - \left(\frac{h/2}{R' + h/2}\right) = \left(\frac{2h}{2R' + h}\right) \tag{4}$$

In equation (4), R'+(h/2) is the radius of curvature of the workpiece 51 of FIG. 1. As a result, the residual stress difference between the inner and outer peripherae of workpiece 51 is:

$$\Delta\sigma = \Delta\epsilon\, E_T = \left(\frac{2h}{2R' + h}\right)E_T$$

and the geometry factor is, by equation (5):

$$K = \left(1 - \left(\frac{2h}{2R' + h}\right)\right)E_T 10^{-6} \tag{5}$$

The geometry factor K is used to multiplied times the right side of equation (6) as follows:

$$\frac{R}{R'} = \left(1 - \frac{E_T}{E}\right)K \tag{6}$$

Multiplying by R' and substituting for K, we have $$R = R'\left(1 - \frac{E_T}{E}\right)\left(1 - \frac{2h}{2R' + h}\right)(E_T 10^{-6}) \tag{7}$$

Letting, $$M = \left(1 - \frac{E_T}{E}\right)1 - \left(\frac{2h}{2R' + h}\right)(E_T 10^{-6})$$

We have R=M R'; where M is the springback factor R/R' and incorporates all mechanical and geometric property terms of equation 6. M is tabulated in table I for strains between 4% and 5%.

TABLE I

| Strain | M |
|---|---|
| 4.0 | 0.9639 |
| 4.2 | 0.9650 |
| 4.4 | 0.9660 |
| 4.6 | 0.9670 |
| 4.8 | 0.9679 |
| 5.0 | 0.9686 |

EXPERIMENT

Stretched formed workpieces 50 were measured and springback data were compared with predictions from the above equations. The results of the experiment are shown in Table 2.

TABLE 2

| Attribute | Sample 1 | Sample 2 |
|---|---|---|
| Part Radius (inches) | 62.76 | 65.72 |
| Height of Parts (inches) | 2.26 | 2.25 |
| Strain (%) | 4.0% | 5.0% |

TABLE 2-continued

| Attribute | Sample 1 | Sample 2 |
|---|---|---|
| Die radius (inches) | 59.82 | 62.76 |
| Predicted Die radius (inches) | 59.72 | 62.94 |
| Error | .16% | .29% |

Figure 3:
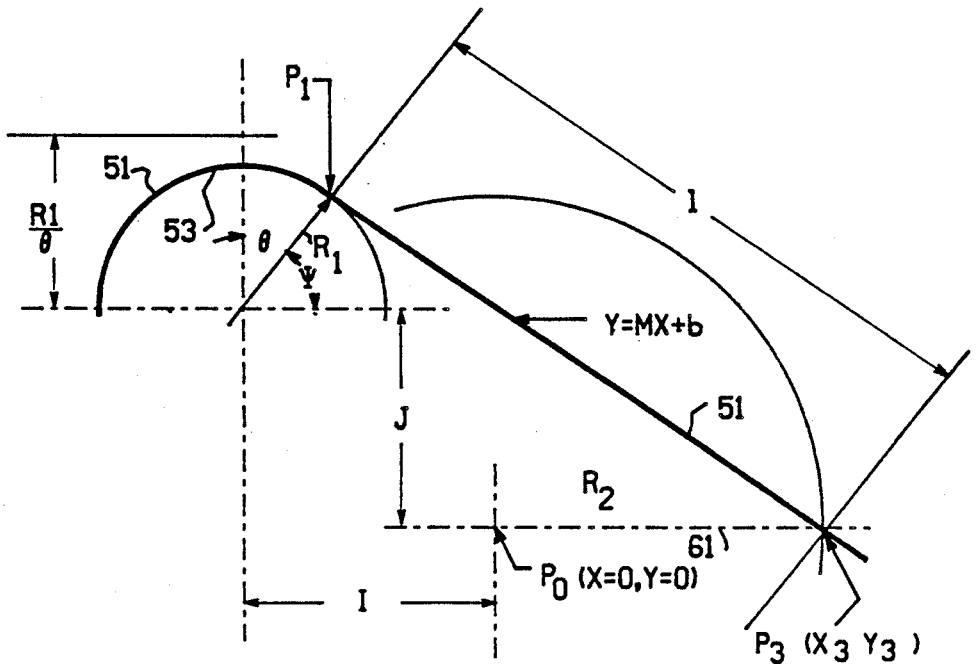
FIG. 3 illustrates the geometry of a stretch/bending press upon which the workpiece of FIG. 1 may be worked according to the stress strain curve of FIG. 2.

Referring to FIG. 3, a geometric representation of the radius of die 53 and the radius of the arm 61 of a stretch/bending press is shown. During press operations, the workpiece 51 would extend from around die 53 to the end of arm 61. The mathematical quantities labelled at FIG. 3 are referrable to the discussion which follows.

The methods hereinafter described may be utilized to calculate more dimensions than those appearing upon FIG. 3. The dimensions chosen were for the purpose of formulating the quantities necessary for programming a General Electric Model 2000 controller installed on a Cyril-Bath Model V-30 stretch press. The General Electric Model 2000 control in particular uses the dimensions "I", "J", and "R" shown on FIG. 3.

Earlier in the discussion, and with reference to FIG. 2, the technique of using strain as a controlling quantity was discussed. In order to accomplish this, the amount of strain corresponding to the angular position of arm 61 needs to be known at each moment in order to adjust the length of arm 61 as the stretching/bending operation ensues. The problem is, then, to describe the length "l" shown on FIG. 3 as a function of the angle theta, $\theta$.

The dimensional quantities used are as follows:

| Quantity | Identification |
|---|---|
| $P_0$ | The center of the coordinate system. |
| $P_1$ | Location of the point where workpiece 51 meets die 53 in during wrapping. |
| $P_3$ | The coordinates of the end of the stretch/bending press arm. |
| $R_2$ | The radius of die 53. |
| $R_2$ | The stretch/bending press arm 61. |
| L | The differential amount of workpiece 51 extending from the end of stretch/bending press arm $R_2$ to a point of tangency upon die 53. |
| $\psi$ | An angle as measured from the horizontal plane to the point of tangency of workpiece 51 upon die 53. |
| O | An angle as measured counterclockwise from the vertical plane to the point of tangency of workpiece 51 upon die 53. |
| J | The X direction vector distance from the radial center of die 53 to the point $P_0$ |
| I | The Y direction vector distance from the radial center of die 53 to the point $P_0$ |

The point $P_1$ coordinates are:

$$P_1 = f(x,y) = (I - (R_1 \sin O)),(J + (R_1 \cos O)) \quad (8)$$

$$\text{When } x = I,\ y = \frac{R_1}{\cos O} + J \text{ and } m = \frac{-1}{1}$$

Therefore:

$$\frac{R_1}{\cos\theta} + J = \frac{-1}{\tan\psi} I + b \text{ where } b = \frac{R_1}{\cos\theta} + J + \frac{-1}{\tan\psi} \quad (9)$$

$$y = \frac{-1}{\tan\psi}(x) + \frac{R_1}{\cos\theta} + J + \frac{I}{\tan\psi} \quad (10)$$

An equation for a circle is:

$$y^2 = x^2 - R^2 \quad (11)$$

Combining the two equations immediately above yields:

-continued

| Quantity | Identification |
|---|---|

$$x^2 - R^2 = \left(\frac{-X}{\tan\psi} + J + \frac{R_1}{\cos\theta} + (x)\frac{-1}{\tan\psi}\right)^2 \quad (12)$$

Rearranging and solving for point $P_3$ will yield the following equation:

$$L = \sqrt{(x_3 - (I - R_1\cos\theta))^2 + (y_3 - (J + R_1\cos\theta))^2} \quad (13)$$

L is precisely the quantity needed to control the stretching/bending process. Depending upon where the position of stretch/bending press arm 61 is, an amount of angular motion will produce a differing amount of elongation of workpiece 51. The defining equation above sets out the relationship and thereby allows digital control of the stretching/bending process.

Figure 4:
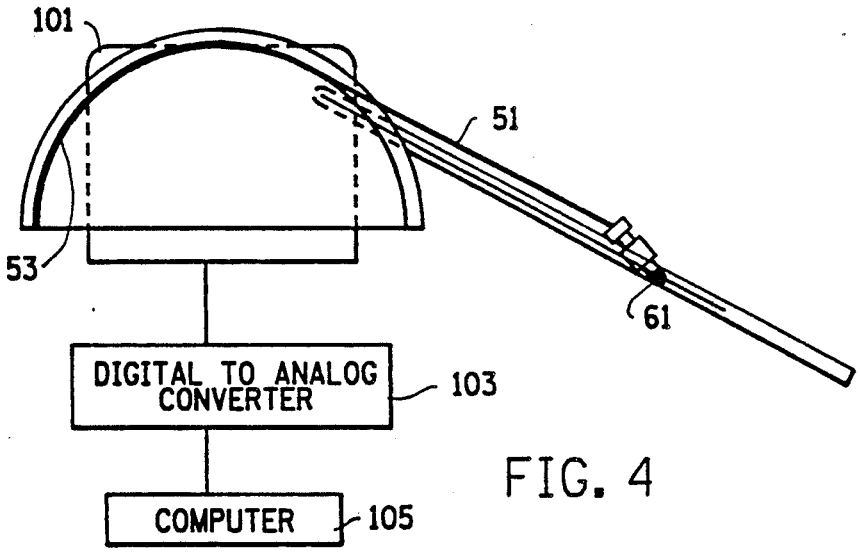
FIG. 4 illustrates the general orientation of the apparatus and method of the present invention as embodied in FIGS. 1–3.

Referring to FIG. 4, the general stretch/bending scheme employing the apparatus and method of the present invention is illustrated. FIG. 4 illustrates arm 61 of the stretch/bending press pulling a workpiece 51 across a die 53. Die 53 is supported by a base 101. The arm 61 of the stretch/bending press is controllably connected to a digital-to-analog converter 103. Digital-to-analog converter 103 is connected to a computer 105. In the event that die 53 has an adjustable radius, computer 105 can be used to adjust the die radius and to keep a constant elongation upon workpiece 51.

Next, the treatment of compound contours is illustrated, treating the compound contour as a series of smaller arcs. This conversion from the lofted shape to arc segments is accomplished by first selecting the number divisions desired. The divisions are then transformed into Cartesian coordinates and then transformed into polar coordinates that determine the arc radii.

The polar transform software module accepts a table of data representing a curve in Cartesian coordinates and generates a new data table containing both the original data table and the data in polar coordinate form. It includes each radius of curvature, the locations of the centers of those radii and start and stop points for each arc segment of curve. Arc segments which contain the same radius and arc center can be eliminated as radectomy data and the original data table can often be significantly reduced.

The program also has the capability of processing data in equation form including polynomials, polar equations, exponentially, etc. The module works with a linked list data structure. In addition to the polar transform function, it also provides curve fitting capability.

Figure 5:
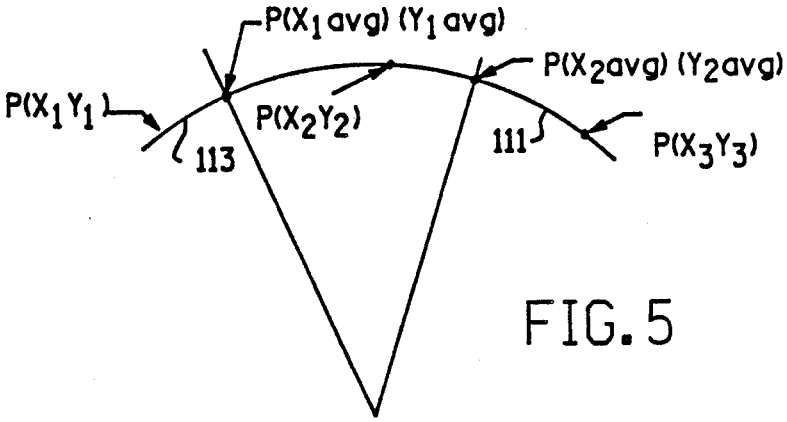
FIG. 5 illustrates the process by which the method of the present invention can generate a bending radius based upon data from a compound contour; and, FIG. 6 illustrates how the bending radii generated in FIG. 5 relate to the stretch press geometry.

Referring to FIG. 5, the polar data is generated in the same manner that a draftsman might generate a curve. He would consider data points such as $P(x_1y_1)$, $P(x_2y_2)$, and $P(x_3y_3)$, three at a time, bisect the data points into groups of two, $P(x_1avg)(y_1avg)$ and $P(x_2avg)(y_2avg)$, and find the intersection of the bisectors. He would swing an arc segment 111 from two successive points with his compass located on the on the intersection of the two bisectors he had just created. He would then include a new data point and repeat this process until he had drawn a curve 113 between all of the data points of the curve. The advantage is that continuous arc segments 111 are tangential and the curve 113 produced is always a smooth curve. It does not require artificial smoothing that other methods required, nor does it wander between points as does a Fourier Series curve fit technique.

The data base generated by this method provides data directly compatible with machine tool languages. This feature permits the software to operate in real time machine environment.

In equation form, this method, illustrated with reference to FIG. 5, is as follows. Given three points of an arc $x_1$, $y_1$, $x_2$, $y_2$, $x_3$, $y_3$, find the radius of the arc R and its center coordinates x=I and y−J.

First, the tangent of the first line is calculated using the following equations.

$$y=m_1x+b_1 \tag{14}$$

$$y\ avg=m_1x\ avg+b \tag{15}$$

Generally:

$$\frac{y_1+y_2}{2}=m\left(\frac{x_1+x_2}{2}\right)+b \tag{16}$$

Since the slope of a normal line is the negative reciprocal of the tangent line (the line between $P(x_1y_1$and $x_2y_2)$), the new slope is given by:

$$m_1=\frac{x_2-x_1}{y_2-y_1} \tag{17}$$

and the Y intercept $b_1$ is therefore given by:

$$b_1=\frac{y_1+y_2}{2}-\left(\frac{x_2-x_1}{y_2-y_1}\right)\left(\frac{x_2+x_1}{2}\right) \tag{18}$$

The equation for line 1 can be solved:

$$y=m_1x+b_1 \tag{19}$$

where:

$$m_1=\frac{x_2-x_1}{y_2-y_1} \text{ and } b_1=\frac{y_1+y_2}{2}+\left(\frac{x_1+x_2}{y_2-y_1}\right)\left(\frac{x_2+x_1}{2}\right)$$

The equation for line 2 can be similarly solved:

$$y=m_2x+b_2 \tag{20}$$

where:

$$m_2=\frac{x_3-x_2}{y_3-y_2} \text{ and } b_2=\frac{y_2+y_3}{2}+\left(\frac{x_3-x_2}{y_3-y_2}\right)\left(\frac{x_2+y_2}{2}\right)$$

Equating line 1 with line 2 to solve for the intersection by elimination of y for both equations;

$$m_1x+b_1=m_2x+b_2$$
$$m_1x-m_2x=b_2-b_1$$

$$x=\frac{b_2-b_1}{m_1-m_2}=I, \text{ the } x \text{ coordinate of the intersection.} \tag{21}$$

Equating line 1 with line 2 to solve for the intersection by eliminating x;

$$\frac{y-b_1}{m_1}=\frac{y-b_2}{m_2} \tag{22}$$

$$y=\frac{m_1m_2}{m_2-m_1}\left(\frac{b_1}{m_1}-\frac{b_2}{m_2}\right)=J \tag{23}$$

$$y=\frac{m_2b_1-m_1b_2}{m_2-m_1} \tag{24}$$

Figure 6:
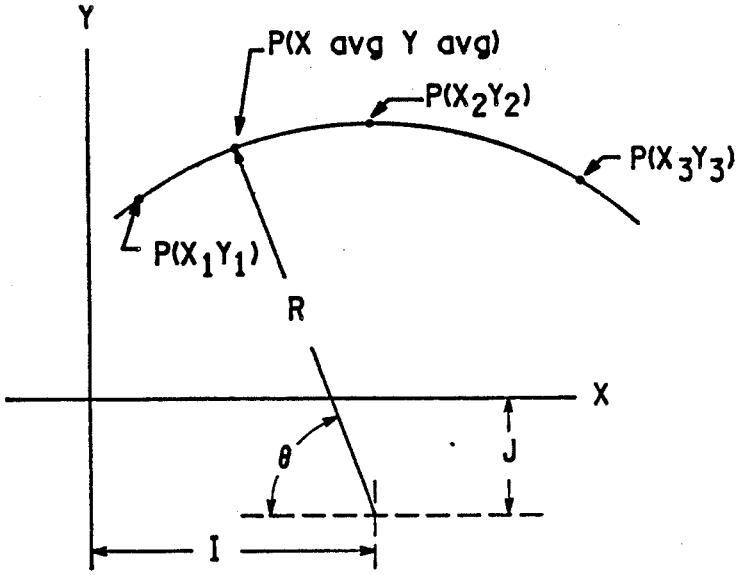

A graphical representation of these values is shown in FIG. 6. FIG. 6 illustrates an R value extending at an angle of Theta from the horizontal plane. The distance J is the distance below the horizontal, or x plane where the radius is located. The points previously illustrated in FIG. 5, including points $P(x_1y_1)$, $P(x_2y_2)$, $P(x_3y_3)$, and $P(x_1avg)$ $(y_1avg)$ are shown. From the graph of FIG. 6,:

$$\text{theta}=\text{arc tan}\ [(y\ avg-J)/(x\ avg-I)] \tag{25}$$

Solving for R yields:

$$R=(y\ avg-J)/\sin\ (Theta) \tag{26}$$

The foregoing disclosure and description of the invention are illustrative and explanitory thereof, and various changes in the calculations may be made to more fully optimize the above invention with respect to various different types of stretch/bending presses of various geometries. The invention may also be varied to take to account differing types, sizes, shapes, and compositions of materials. All possible combinations of the above formulations may be combined to yield the specific shape desired for any specific application. The disclosure identifies an approach to the solution of a problem and is not dependent upon the specific embodiment used to practice the invention. Therefore departures from the exemplary points illustrated in the examples above may be made without departing from the spirit and scope of the invention.

What is claimed is:

1. A method of shaping a workpiece to a desired radius utilizing springback, die radius and geometry factor, comprising the steps of:

computing the springback of said workpiece based upon its stress strain characteristics;

computing the geometry factor of said workpiece based upon the stress difference between the inner and outer curvatures of the desired finished radius of the workpiece, the dimensions of the workpiece, and the stress strain characteristics of the workpiece;

computing the radius of a die as a function of said springback, said geometry factor and the desired radius of the workpiece;

constructing a die based upon said computed radius; and, stretchably shaping said workpiece about said die.

2. The method of claim 1 further comprising the step of stretchably bending said workpiece over said die.

3. The method of claim 2 wherein said stretchably bending step is performed by controlling the elongation of said workpiece.

4. The method of claim 3 wherein said stretchably bending by controlling elongation step is performed by computing the amount of elongation of said workpiece as a function of the rate of angular bending over said die, and maintaining said computed elongation as said workpiece is stretchably bend about said die.

5. The method of claim 4 wherein said computing the amount of elongation of said workpiece step is performed according to the following equation:

$$L = \sqrt{(x_3 - (I - R_1\mathrm{Cos}O))^2 + (y_3 - (J + R_1\mathrm{Cos}O))^2}\ .$$

6. The method of claim 1 wherein computing the springback step further comprises the steps of:

computing the tangent modulus of the workpiece equal to the change in stress divided by the change in strain in the area of interest of the stress strain curve of the material of which said workpiece is constructed;

subtracting from one the quotient of said tangent modulus divided by Young's modulus, to form the computed springback.

7. The method of claim 1 wherein computing the springback step is performed according to the following equation:

$$\frac{R}{R'} = \left(1 - \frac{E_T}{E}\right)K.$$

8. The method of claim 1 wherein computing the geometry factor step is performed according to the following equation:

$$K = \left(1 - \left(\frac{2h}{2R' + h}\right)\right)E_T 10^{-6},$$

9. The method of claim 1 wherein said computing the radius step is performed according to the following equation:

$$R = R'\left(1 - \frac{E_T}{E}\right)\left(1 - \frac{2h}{2R' + h}\right)(E_T 10^{-6}).$$

10. The method for shaping a workpiece, having a compound contour, to a desired radius comprising the steps of:

measuring three points from an arc of said compound workpiece;

calculating the tangent line between the first and second of said three points from said arc;

calculating the tangent line between the second and third of said three points from said arc;

calculating the x and y coordinates of the intersections of said tangent lines;

calculating the angle from a point on a base parallel to the x axis, of said x and y coordinates of the intersections of said tangent lines;

calculating the radius from a point on a base parallel to the x axis, of said x and y coordinates of the intersections of said tangent lines;

constructing a die having said calculated radius; and, stretchably shaping said workpiece about said die while maintaining the constant elongation of said workpiece as said workpiece is stretchably bent about said die.

11. The method of claim 10 wherein said calculating the tangent line between the first and second of said three points from said arc step is performed according to the following equations:

$$y = m_1x + b_1$$
$$y\,\mathrm{avg} = m_1x\,\mathrm{avg} + b$$

$$\frac{y_1 + y_2}{2} = m\left(\frac{x_1 + x_2}{2}\right) + b$$

$$m_1 = \frac{x_2 - x_1}{y_2 - y_1}$$

$$b_1 = \frac{y_1 + y_2}{2} - \left(\frac{x_2 - x_1}{y_2 - y_1}\right)\left(\frac{x_2 + x_1}{2}\right)$$

$$y = m_1x + b_1.$$

12. The method of claim 11 wherein said calculating the tangent line between the second and third of said three points from said arc step is performed according to the following equations:

$$y = m_2x + b_2$$
$$y\,\mathrm{avg} = m_2x\,\mathrm{avg} + b$$

$$\frac{y_1 + y_2}{2} = m\left(\frac{x_1 + x_2}{2}\right) + b$$

$$m_2 = \frac{x_3 - x_2}{y_3 - y_2}$$

$$b_2 = \frac{y_2 + y_3}{2} - \left(\frac{x_3 - x_2}{y_3 - y_2}\right)\left(\frac{x_3 + x_2}{2}\right)$$

$$y = m_2x + b_2.$$

13. The method of claim 12 wherein said calculating the x and y coordinates of the intersections of said tangent lines step is performed according to the following equations:

$$m_1x + b_1 = m_2x + b_2$$
$$m_1x - m_2x = b_2 - b_1$$

$$x = \frac{b_2 - b_1}{m_1 - m_2} = I, \text{ the } x \text{ coordinate of the intersection}$$

$$\frac{y - b_1}{m_1} = \frac{y - b_2}{m_2}$$

$$y = \frac{m_1m_2}{m_2 - m_1}\left(\frac{b_1}{m_1} - \frac{b_2}{m_2}\right) = J$$

$$y = \frac{m_2b_1 - m_1b_2}{m_2 - m_1}.$$

14. The method of claim 13 wherein said calculating the angle theta, from a point on a base parallel to the x axis, of said x and y coordinates of the intersections of said tangent lines step is performed according to the following equation:

theta=arc tan [(y avg–J) (x avg–I)]

15. The method of claim 14 wherein said calculating calculating the radius from a point on a base parallel to the x axis, of said x and y coordinates of the intersections of said tangent lines step is performed according to the following equation:

R =(y avg−J)/ sin (Theta)

16. A method of shaping a workpiece to a desired radius utilizing springback, die radius and geometry factor comprising the steps of:

computing the springback of said workpiece based upon its stress strain characteristics;

computing the radius of a die upon which a workpiece is to be stretchably bent, taking to account the stress strain characteristics of the workpiece to be shaped, said radius to compensate for the springback characteristic of said workpiece;

computing the geometry factor of said workpiece based upon the stress difference between the inner and outer curvatures of the desired radius of the workpiece, the dimensions of the workpiece, and the stress strain characteristics of the workpiece; and, computing the radius of a die by computing the product of said springback, said geometry factor and the desired finished radius of the workpiece.

17. The method of claim 16 wherein computing the springback step further comprises the steps of:

computing the tangent modulus of the workpiece equal to the change in stress divided by the change in strain in the area of interest of the stress strain curve of the material of which said workpiece is constructed;

substracting from one the quotient of said tangent modulus divided by Young's modulus, to form the computed springback.

18. The method of claim 16 wherein computing the springback step is performed according to the following equation:

$$\frac{R}{R'} = \left(1 - \frac{E_T}{E}\right)K.$$

19. The method of claim 16 wherein computing the geometry factor step is performed according to the following equation:

$$K = \left(1 - \left(\frac{2h}{2R' + h}\right)\right)E_T 10^{-6},$$

20. The method of claim 16 wherein said computing the radius step is performed according to the following equation:

$$R = R'\left(1 - \frac{E_T}{E}\right)\left(1 - \frac{2h}{2R' + h}\right)(E_T 10^{-6}).$$

* * * * *